US007706709B2

(12) United States Patent
Okamoto et al.

(10) Patent No.: US 7,706,709 B2
(45) Date of Patent: Apr. 27, 2010

(54) IMAGE FORMING APPARATUS

(75) Inventors: Yoshinari Okamoto, Toyoake (JP); Yasunari Yoshida, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 880 days.

(21) Appl. No.: 11/475,170

(22) Filed: Jun. 27, 2006

(65) Prior Publication Data

US 2006/0291884 A1 Dec. 28, 2006

(30) Foreign Application Priority Data

Jun. 27, 2005 (JP) ..... 2005-186897

(51) Int. Cl.
*G03G 15/20* (2006.01)

(52) U.S. Cl. ..... 399/70

(58) Field of Classification Search ..... 399/69, 399/70

See application file for complete search history.

(56) References Cited

U.S. PATENT DOCUMENTS 5,241,349 A * 8/1993 Nagasaka ..... 399/70
2004/0246512 A1 12/2004 Miyamoto

FOREIGN PATENT DOCUMENTS

| | | |
|---|---|---|
| JP | 61-262777 | 11/1986 |
| JP | 11-098289 | 4/1999 |
| JP | 2000-318265 | 11/2000 |
| JP | 2002-305614 | 10/2002 |
| JP | 2003-309684 | 10/2003 |
| JP | 2004-148724 | 5/2004 |

OTHER PUBLICATIONS

Japanese Office Action, Patent Application No. 2005-186897, Dec. 2, 2008.

* cited by examiner

*Primary Examiner*—David M Gray
*Assistant Examiner*—Ruth N Labombard
(74) *Attorney, Agent, or Firm*—Banner & Witcoff, Ltd.

(57) ABSTRACT

An image forming apparatus that includes: a reading unit; an image forming unit that forms an image on a sheet; a fixing unit; a mode selecting unit that selects a first mode from plural modes, in the first mode of which a document is read by the reading unit and the image is formed by the image forming unit; a temperature controlling unit that controls a temperature of the fixing unit to be one of a fixing state a standby state and a sleep state; a sleep transferring unit that transfers to the sleep state; and a switching unit that switches the fixing unit to the standby state on selecting the first mode. The temperature is controlled to transfer to the standby state on switching to transfer to the standby state, and otherwise, controlled to be in the sleep state is until receiving an instruction to the first mode.

6 Claims, 9 Drawing Sheets

IMAGE FORMING APPARATUS

CROSS REFERENCE TO RELATED APPLICATION

This application claims priority from Japanese Patent Application No. 2005-186897, filed Jun. 27, 2005, the contents of which are hereby incorporated by reference into the present application.

TECHNICAL FIELD

Aspects of the present invention relate to an image forming apparatus.

BACKGROUND

In an image forming apparatus such as a laser printer, image data is formed as a toner image on a sheet. The toner image is fixed to the sheet by a fixing unit that is heated to a temperature, which enables a thermal fixing process (hereinafter, a thermal process enabled temperature).

When the fixing unit is always heated to the thermal process enabled temperature, an image formation such as a copying process can be always conducted. However, the heating of the fixing unit consumes a large amount of power. This is not preferable for a user who wishes to suppress power consumption.

JP-A-2002-305614 discloses once storing an image data in a memory without outputting it, when a facsimile is received in a power save mode in which a fixing unit is set to a low temperature. The facsimile is output later at the time of other image formation such as a copy output. This reduces the number of heating the fixing unit. The power consumption is suppressed.

However, in case of a copying process, even when a user intends to promptly complete the copying process, heating of the fixing unit starts after printing is instructed by operating a copy button. The user must wait until the fixing unit is heated to a thermal process enabled temperature. It fails to satisfy a user's request for prompt copying process.

Aspects of the invention provide an image forming apparatus in which, in response to a user's request, power consumption can be suppressed, or the copy time can be shortened.

SUMMARY

According to an aspect of the present invention, an image forming apparatus includes: a reading unit that reads a document; an image forming unit that forms an image on a sheet based on image data read by the reading unit; a fixing unit that thermally fixes the image formed on the sheet; a mode selecting unit that selects a first mode from a plurality of modes, in the first mode of which a document is read by the reading unit and the image is formed by the image forming unit; a temperature controlling unit that controls a temperature of the fixing unit to be one of states, including: a fixing state in which the fixing unit thermally fixes the image; a standby state in which the temperature of the fixing unit is lower than the temperature in the fixing state; and a sleep state in which the temperature of the fixing unit is lower than the temperature in the standby state; a sleep transferring unit that transfers the fixing state or the standby state to the sleep state, after a sleep transfer time has elapsed from an end of the thermal fixing by the fixing unit; and a switching unit that switches whether or not the fixing unit in the sleep state is transferred to the standby state, when the first mode is selected by the mode selecting is unit. When the switching unit switches to transfer to the standby state, the temperature controlling unit controls the temperature of the fixing unit to transfer from the sleep state to the standby state, and when the switching unit switches not to transfer to the standby state, the temperature controlling unit controls the temperature of the fixing unit to be in the sleep state until receiving a starting instruction of a copying process.

The second mode other than the first mode includes a facsimile mode to transmit facsimile, or a scanner mode to read a document. Sleep transfer time includes a time which, in the case where an instruction for starting a copying process is not again received after a printing process has ended, elapses until the state is transferred to the sleep state. When the user operates an operation unit to start the copying process, instruction for starting a copying process may be given to the temperature controlling unit. When a detection unit including a detection sensor detects that a document is set on a document table, the instruction may be given to the temperature controlling unit.

DETAILED DESCRIPTION OF THE INVENTION

A first illustrative aspect of the invention will be described with reference to FIGS. 1 to 9.

1. Whole Configuration

Figure 1:
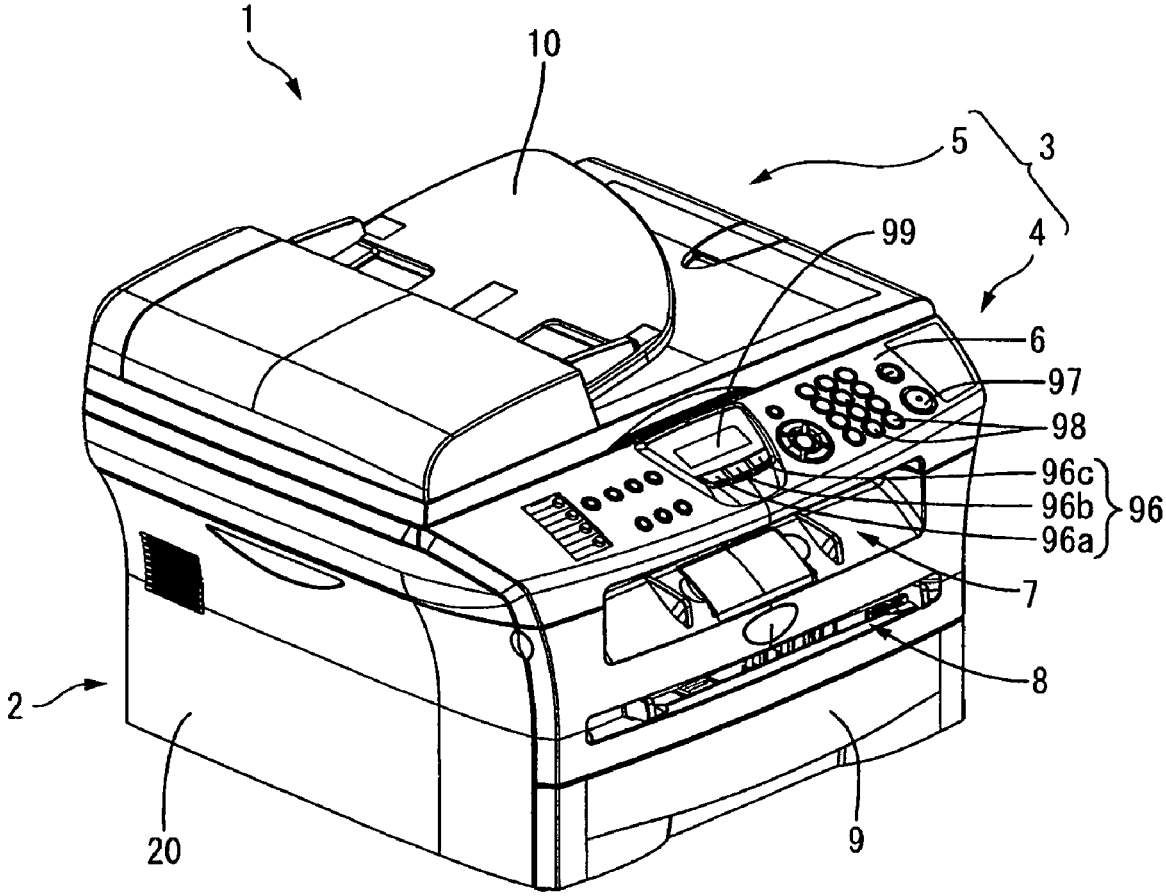
FIG. 1 is a perspective view showing an appearance of a multifunction machine of an illustrative aspect of the invention.

An image forming apparatus of the illustrative aspect is a multifunction machine 1 having a printer function, a scanner function, a copier function and, the like. FIG. 1 is a perspective view showing the appearance of the multifunction machine. The multifunction machine 1 includes: an image forming unit 2 incorporating a feeding section 21, an image forming section 22, and the like; and an automatic document transporting and reading unit (hereinafter, referred to as "reading unit") 3. The reading unit 3 includes: an image reading apparatus 4 in which a rectangular document table 4*a* is disposed on the upper face; and an automatic document feeder (hereinafter, abbreviated to ADF) 5, which is placed so as to cover the document table 4*a*.

An operation section 6 through which the user can apply various operations is disposed one end side (in FIG. 1, in the lower right direction of the sheet) of the image reading apparatus 4.

A mode selection switch 96, a start key 97, various operation buttons 98, and a liquid-crystal display touch panel 99 are disposed in the operation section 6.

The mode selection switch 96 allows any one of three kinds of functional modes (modes in which a printer function, a scanner function, and a copier function are respectively enabled) to be selected. Specifically, a copy mode key 96*a* for selecting a copy mode, a FAX mode key 96*b* for selecting a FAX (facsimile) mode, and a scanner mode key 96*c* for selecting a scanner mode are laterally arranged.

The start key 97 is a switch for starting an operation corresponding to the selected functional mode. When the key is depressed, to turn ON the copy mode, a process of copying a document placed on the document table 4*a* starts. When the start key 97 is depressed in the FAX mode or the scanner mode, an operation such as reading of a FAX transmission document or reading of a scanner document is conducted.

On the touch panel 99, a set menu button (not shown) is displayed as a result of a predetermined operation, and, when the set menu button is touched, a screen related to various settings is displayed.

A sheet eject hole 7, which is opened continuously to a sheet discharge tray 2*a* is formed in a position under the operation section 6. A manual feed port 8, which horizontally elongates and is opened in a slit-like manner is formed under the sheet eject hole 7. Below the port, a sheet feed cassette 9 is disposed so as to be attachably detachable from the same face as the face in which the operation section 6 and the like are disposed.

In the following description, in the multifunction machine 1, the side of the face in which the operation section 6 is disposed (in FIG. 1, in the lower right direction of the sheet) is called "front side". The opposite side (in FIG. 1, in the upper left direction of the sheet) is called "rear side".

Figure 2:
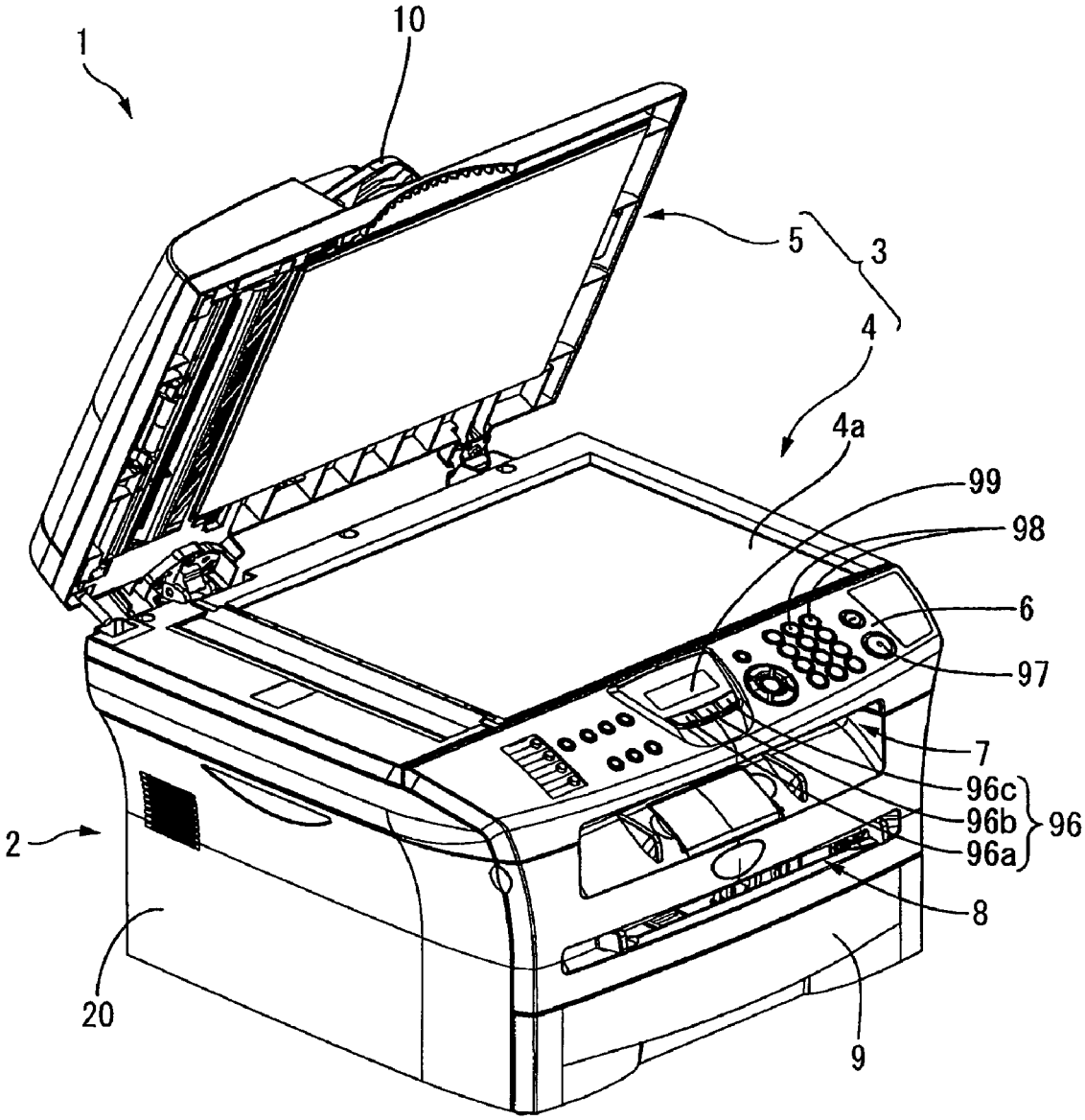
FIG. 2 is a perspective view of the multifunction machine showing a state where a reading unit is opened.

FIG. 2 is a perspective view of the multifunction machine 1 showing a state in which the reading unit 3 is opened. As shown in the figure, in the reading unit 3, a rear end portion, which is opposite to the operation section 6 is swingably pivoted on the rear end side of the upper face of the image forming unit 2.

2. Configuration of Various Parts (1) Image Forming Unit

Figure 3:
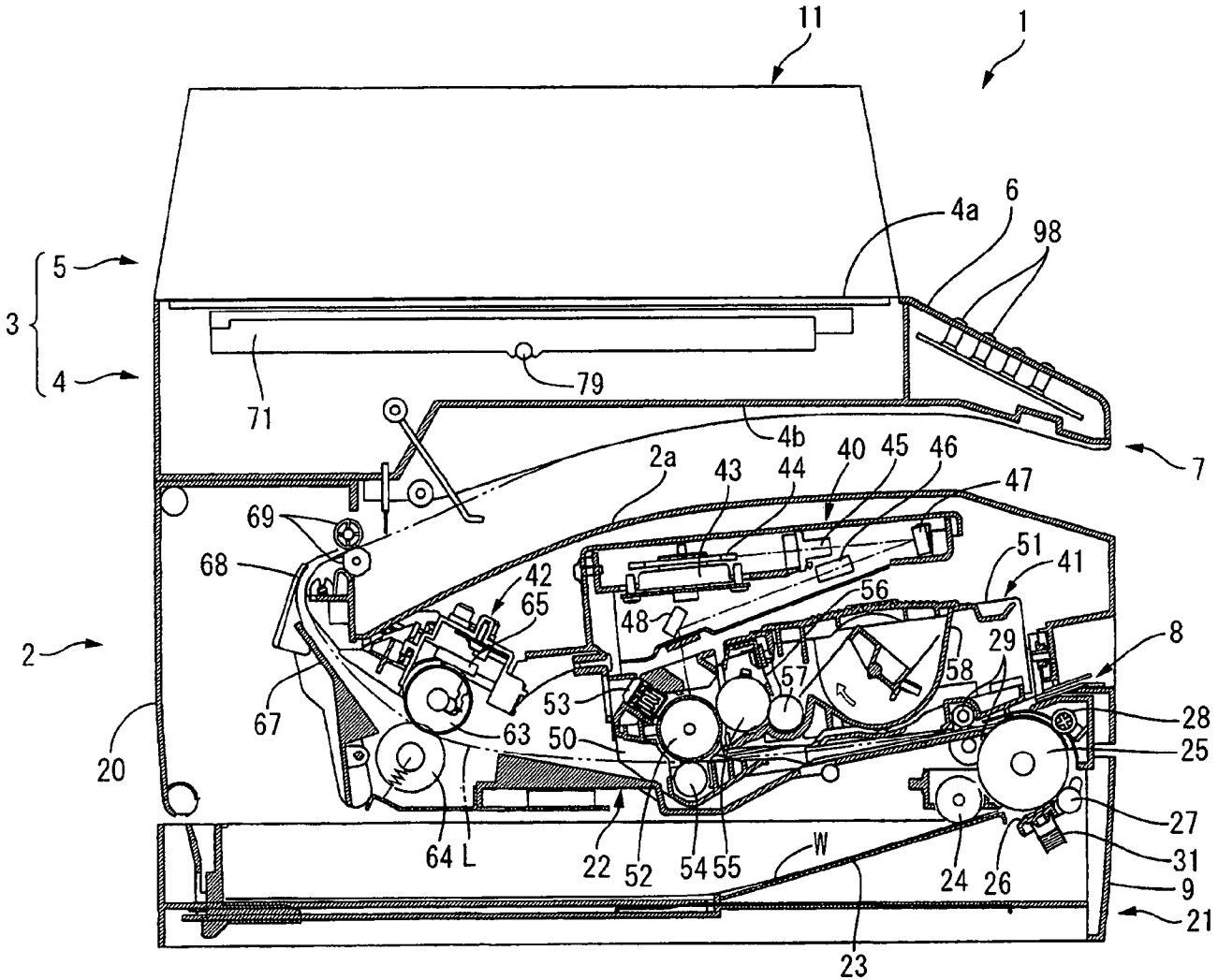
FIG. 3 is a side section view showing the multifunction machine.

The configuration of the image forming unit 2 will be described with reference to FIG. 3. FIG. 3 is a side section view showing the multifunction machine 1 as viewed in the axial direction of a sheet feed roller 25 or the like. In the figure, the right side of the sheet is the front side of the multifunction machine 1. The left side of the sheet is the rear side of the multifunction machine 1.

The feeding section 21, which feeds a sheet W and the image forming section 22, which forms a predetermined image on the fed sheet W are disposed in a casing 20 of the image forming unit 2. The sheet discharge tray 2*a* that is used for holding the sheet W on which an image is formed by the image forming section 22 and is discharged is placed in an upper portion of the image forming section 22.

(a) Feeding Section

The feeding section 21 includes: the sheet feed cassette 9; a sheet presser 23 disposed in the sheet feed cassette 9; a delivery roller 24, which is disposed above a front side end portion of the sheet feed cassette 9; the sheet feed roller 25 and a separation pad 26; an opposing roller 27, which opposes the sheet feed roller 25; a paper dust removing roller 28; and a registration roller 29, which is disposed downstream from the paper dust removing roller 28 in the transport direction of the sheet W.

The sheet feed cassette 9 is detachably attached to a bottom portion of the casing 20 and accommodates a stack of the sheets W therein.

The sheet presser 23 is swingably supported at an end portion, which is remote from the sheet feed roller 25, so that an end portion, which is close to the sheet feed roller 25 is vertically movable. The sheet presser is urged upwardly by a spring (not shown).

The delivery roller 24 is set so as to butt against the sheet W stacked in the uppermost position on the sheet presser 23 in the sheet feed cassette 9. The delivery roller 24 sends the sheet W to a position between the sheet feed roller 25 and the separation pad 26, where the sheet can be transported by the sheet feed roller 25.

The separation pad 26 is disposed at a position, which is opposed to the sheet feed roller 25 and pressed toward the sheet feed roller 25 by a spring 31, which is disposed behind the separation pad 26. The separation pad 26 prevents a supply of plural sheets W in a stacked state into a transportation path (two-dot chain line L in FIG. 3) from occurring.

Then, the sheet W is subjected to paper dust removal by the paper dust removing roller 28 while the direction is changed by about 180 deg. by the sheet feed roller 25. The sheet W is then sent to the registration roller 29.

The registration roller 29 is configured by a pair of rollers, and its operations of driving and stopping are controlled by a controller (not shown) on the basis of a detection timing of a position sensor (not shown) placed in the vicinity of the sheet feed roller 25. As a result of the control, a skew of the sheet W is corrected.

(b) Image Forming section

The image forming section 22 includes a scanner unit 40, a process unit 41 and a fixing unit 42.

(Scanner Unit)

As shown in FIG. 3, the scanner unit 40 is disposed in an upper portion of the casing 20. The scanner unit 40 includes a laser emitting portion (not shown), a polygon mirror 44, which is rotated by a polygon motor 43, lenses 45 and 46, reflecting mirrors 47 and 48, etc. A laser beam, which is emitted from the laser emitting portion and is formed on the basis of predetermined image data, is passed through or reflected by the polygon mirror 44, the lens 45, the reflecting mirror 47, the lens 46 and the reflecting mirror 48 in this sequence. The laser beam is irradiated on the surface of a photosensitive drum 52 in the process unit 41, which will be described later, by high-speed scanning.

(Process Unit)

In the multifunction machine 1, the process unit 41 is detachably disposed with respect to the body of the image forming unit 2.

The process unit 41 is configured by a drum cartridge 50, and a developing cartridge 51.

The drum cartridge 50 of the process unit 41 includes the photosensitive drum 52, a scorotron charger 53, and a transfer roller 54. The developing cartridge 51 includes a developing roller 55, a layer thickness restricting blade 56, which is pressingly contacted to the developing roller 55, a toner supplying roller 57 and a toner box 58, which is filled with a toner.

The photosensitive drum 52 is disposed in the side of the developing roller 55 so as to be rotatable in a clockwise direction in a state where the drum opposes the developing roller 55.

The scorotron charger 53 is a positively charging scorotron charger, and disposed with being spaced by a predetermined gap from the photosensitive drum 52 so as not to be contacted therewith.

In accordance with rotation of the photosensitive drum 52, the surface of the photosensitive drum 52 is first uniformly positive-charged by the scorotron charger 53. Then the surface is exposed by the high-speed scanning of the laser beam from the scanner unit 40 so that an electrostatic latent image based on predetermined image data is formed.

Next, when the toner, which is carried on the developing roller 55 and positively charged, is opposed and contacted with the photosensitive drum 52 with rotation of the developing roller 55, the toner is supplied to the electrostatic latent image, which is formed on the surface of the photosensitive drum 52.

The transfer roller 54 is placed under the photosensitive drum 52 so as to oppose the photosensitive drum 52 and supported on the drum cartridge 50 so as to be rotatable in a counterclockwise direction. The visible image, which is carried on the surface of the photosensitive drum 52, is transferred to the sheet W when the sheet W passes between the photosensitive drum 52 and the transfer roller 54.

(Fixing Unit)

The fixing unit 42 is disposed downstream (on the rear side) from the process unit 41 in the sheet transportation direction. The fixing unit 42 includes: a heating roller 63 for heating and fixing the transferred toner on the sheet; a pressing roller 64, which is placed while opposing the heating roller 63 and presses the fed sheet against the heating roller 63; and a thermostat 65.

The heating roller 63 includes a plain metal pipe, which is a cylindrical member, and a halogen lamp is incorporated therein along the axial direction of the pipe. The surface of the heating roller 63 can be heated by the halogen lamp to a fixing temperature (for example, 200° C.) at which the toner is fixed to the sheet.

As described in detail later, in the case where an instruction (turning ON of the start key 97) for starting the image formation is given when the power mode is in a sleep mode in which heating is not conducted, the fixing unit 42 (the heating roller 63) is heated to the fixing temperature at which a thermal fixing process is enabled. After a sleep mode transfer time, which will be described later has elapsed from an end of the image formation, the heating is stopped and the power mode is transferred to the sleep mode.

The pressing roller 64 includes a roller shaft made of a metal, and a rubber roller, which covers around the pressing roller shaft and is formed by a rubber material. Because of the rubber roller of the pressing roller, the pressing roller is elastically pressed against the plain metal pipe of the heating roller 63 and driven by rotation of the heating roller 63.

The thermostat 65 includes, for example, a bimetal. In accordance with heat generated from the heating roller 63, the thermostat 65 turns ON/OFF the power source of the heater for heating the heating roller 63 and prevents the heating roller 63 from being excessively heated.

In the fixing unit 42, during a period when the sheet W passes between the heating roller 63 and the pressing roller 64, the heating roller 63 heats and presses the toner, which has been transferred onto the sheet W by the process unit 41, thereby fixing the toner to the sheet.

Furthermore, the heating roller 63 transports the sheet W to which the image has been fixed, to discharging rollers 69 via a discharge path formed by guiding members 67, 68. Then, the discharging rollers 69 discharge the sent sheet W onto the sheet discharge tray 2*a*.

(2) Reading Unit

The reading unit 3 includes the image reading apparatus 4 and the ADF 5. The image reading apparatus 4 is placed so that, in a region above the sheet discharge tray 2*a* of the image forming unit 2, a lower face 4*b* opposes and covers the sheet discharge tray 2*a*.

The reading unit 3 is configured as a flatbed scanner. In the flatbed configuration, when the ADF 5 is opened toward the rear side, the document table 4*a* is exposed (see FIG. 2), so that reading in the copying process or the like can be conducted in a state where a book or other various documents is placed on the document table 4*a*.

The process of reading the document M is conducted in either of the case where the document M is placed on the document table 4*a* and the case where the ADF 5 is used. In the case where the document M is placed on the document table 4*a*, a CIS (contact image sensor) 71 is moved along a shaft 79 elongating in the transportation direction of the document M, and also along the document table 4*a*, and each line of the document M placed on the document table 4*a* is read. By contrast, in the case where the ADF 5 is used, the CIS 71 is moved to the left end side of the document table 4*a* and held to the position, and each line of the document M transported by the ADF 5 is then read.

3. Electrical Configuration

Figure 4:
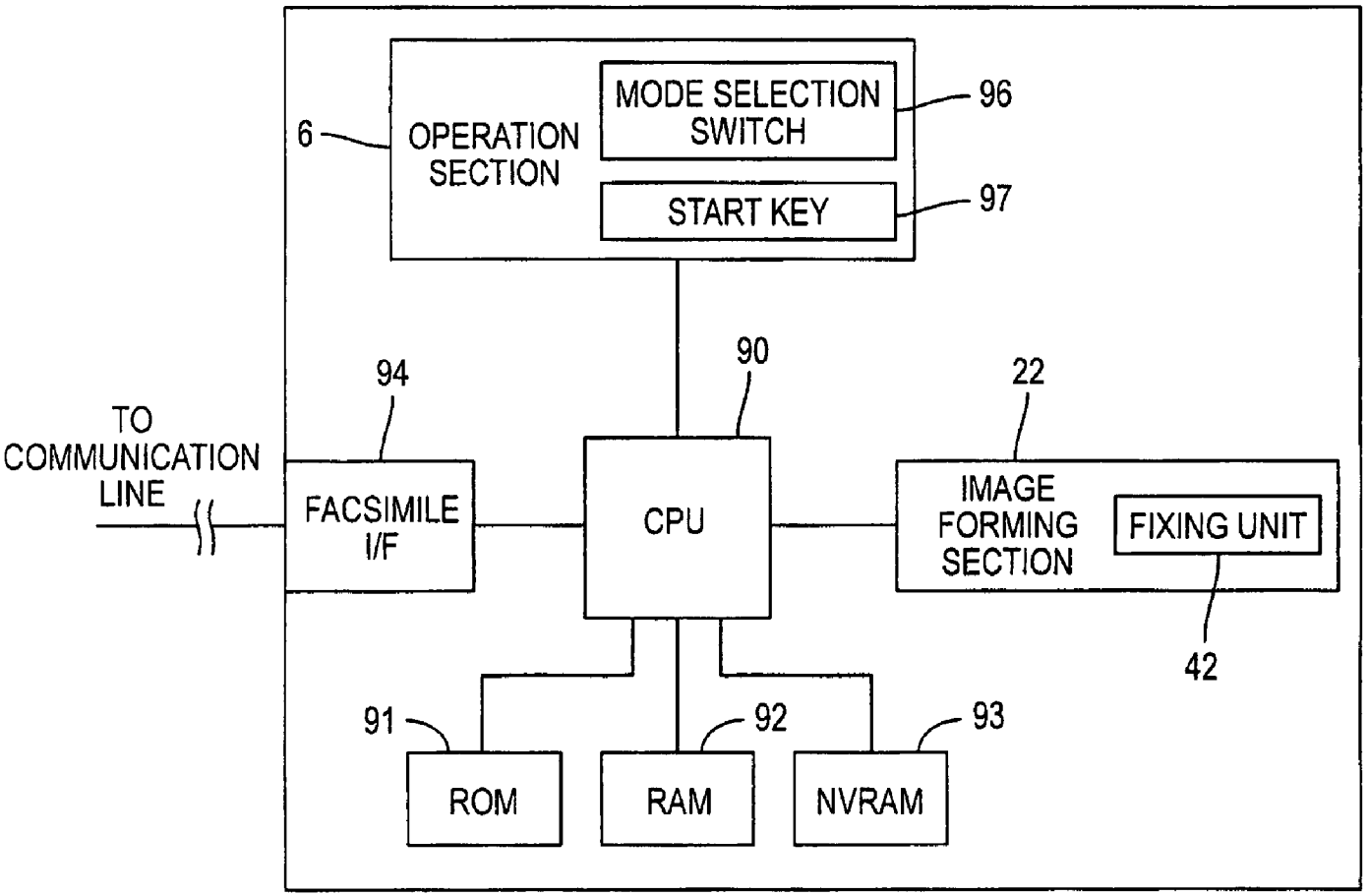
FIG. 4 is a block diagram showing the electrical configuration of the multifunction machine.

FIG. 4 schematically shows the electrical configuration of the multifunction machine 1.

The multifunction machine 1 includes: the operation section 6, which receives various input operations; the image forming section 22 in which reading and printing of image data, and heating and fixation by the fixing unit 42 are conducted; a ROM 91; a RAM 92; an NVRAM 93 (nonvolatile memory); a CPU 90; and a facsimile I/F 94, which is connected to a communication line such as a telephone line.

In the NVRAM 93, the sleep mode transfer time TX is previously stored as a default time Ta at shipment.

The sleep mode transfer time Tx is a time, which elapses until the mode is transferred to the sleep mode in the case where the printing process has ended and an instruction for printing (turn-on of the start key 97) is not again received.

At the time of shipment/production, for example, the default time Ta is set to 5 minutes in case of a monochrome laser multifunction machine, and to 30 minutes in case of a color laser multifunction machine.

In the operation section 6, various settings are enabled by touching the set menu button (not shown) of the touch panel 99.

Figure 5:
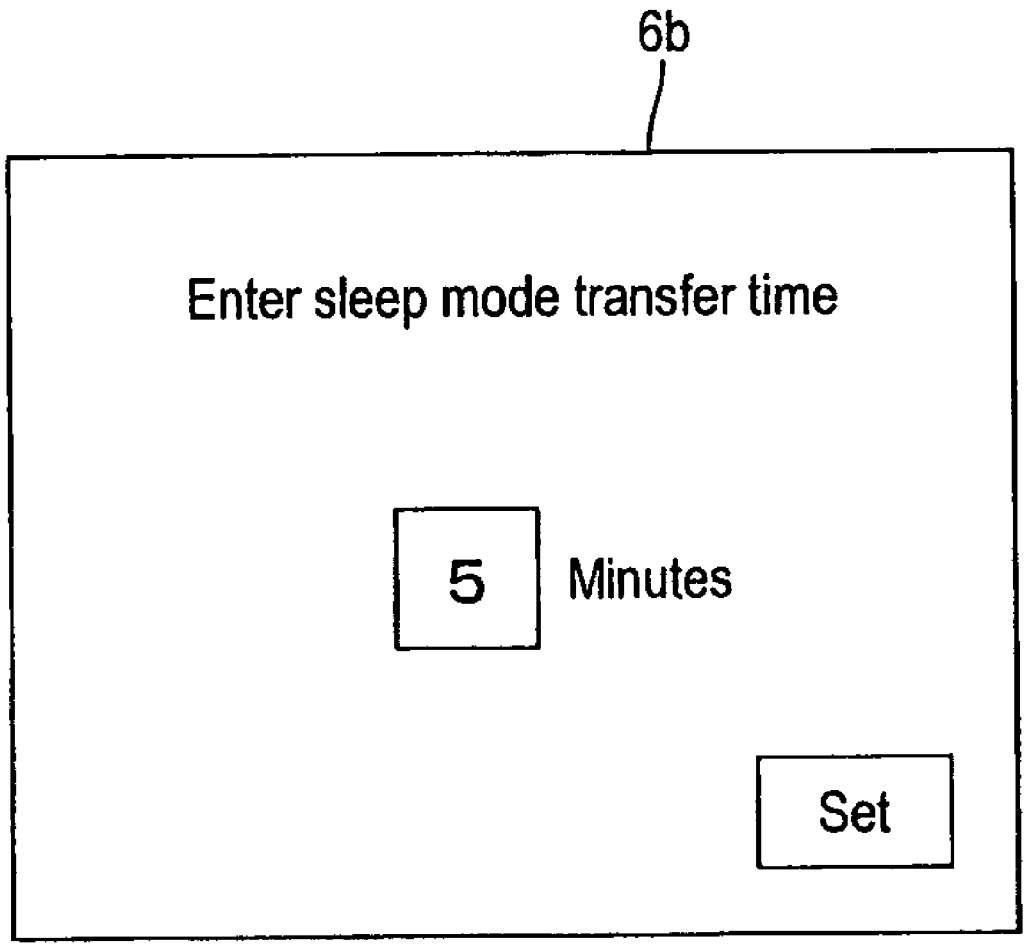
FIG. 5 is a view showing a display of a sleep mode transfer time setting screen.

When a set button for the sleep mode transfer time in the set menu of the touch panel 99 is touched, a sleep mode transfer time setting screen shown in FIG. 5 is displayed. In the sleep mode transfer time setting screen, the sleep mode transfer time Tx can be switched in the unit of, for example, 1 minute by operating the operation buttons 98 or the like. The touch panel 99 of the operation section 6 corresponds to the sleep transfer time setting unit in the illustrative aspect of the invention.

The user who wishes to suppress the power consumption sets the sleep mode transfer time Tx to be shorter than the default time Ta, so that heating of the fixing unit 42 is stopped earlier and the power consumption can be suppressed.

On the other hand, in the case where heating of the fixing unit 42 is stopped earlier after the copying process ends, the user who wishes to frequently make a copy must wait until heating is conducted from the sleep temperature (room temperature or the like) to the fixing temperature (200° C.), when the copying process is to start again. Therefore, the user who wishes to frequently make a copy sets the sleep mode transfer time Tx to be longer than the default time Ta. The printing process can be conducted promptly without waiting until heating is conducted from the sleep temperature to the fixing temperature.

After the printing process ends, when the CPU 90 detects that the sleep mode transfer time Tx has elapsed, the CPU transfers the current power mode to the sleep mode and stops heating of the fixing unit 42. At this time, in the case where the functional mode is the copy mode and invalidation of mode switching, which will be described later is not set, the CPU 90 transfers the functional mode to the FAX mode (or the scanner mode).

Figure 6:
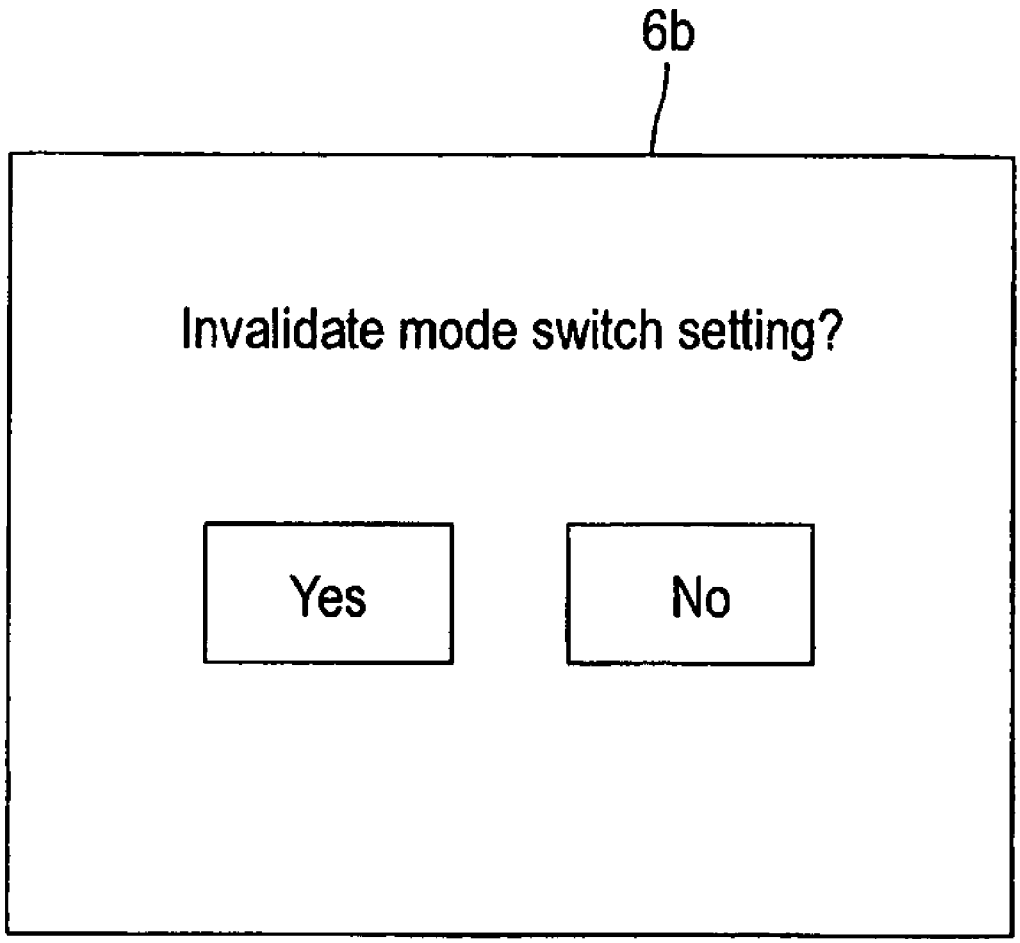
FIG. 6 is a view showing a display of a mode switching setting screen.

When a mode switching invalidation set button in the set menu of the touch panel 99 is touched, a mode switching invalidation selection screen shown in FIG. 6 is displayed.

When invalidation of the mode switching is set in the mode switching invalidation selection screen (YES in FIG. 6 is selected), the setting is stored in the NVRAM 93. When invalidation of the mode switching is once set, the transfer from the copy mode to the FAX mode (the scanner mode) is not conducted in the transfer to the sleep mode. Alternatively, also in a case other than the transfer to the sleep mode, when invalidation of the mode switching is once set, even a depression of the mode selection switch 96 may not switch the functional mode. The touch panel 99 of the operation section 6 corresponds to the default mode setting unit in the illustrative aspect of the invention The CPU 90 switches over three kinds of power modes including: the fixing mode in which the fixing unit 42 (the surface of the heating roller 63) is set to the fixing temperature (200° C.) at which the toner can be thermally fixed to the sheet; the standby mode in which a standby temperature (170° C.), which is lower than the fixing temperature is set; and the sleep mode in which heating of the fixing unit 42 is stopped (the sleep temperature, which is lower than the temperature of the standby state is set).

In the case where the functional mode is the copy mode, when the CPU 90 detects that the start key 97 is depressed, the CPU transfers the power mode to the fixing mode, so that the fixing unit 42 is heated to the fixing temperature and then the printing process starts.

In the sleep mode, when the CPU 90 detects that the copy mode key 96*a* of the mode selection switch 96 is depressed, the CPU transfers the power mode to the standby mode. When the start key 97 is depressed during a copy process, the standby mode is transferred to the fixing mode.

Figure 7:
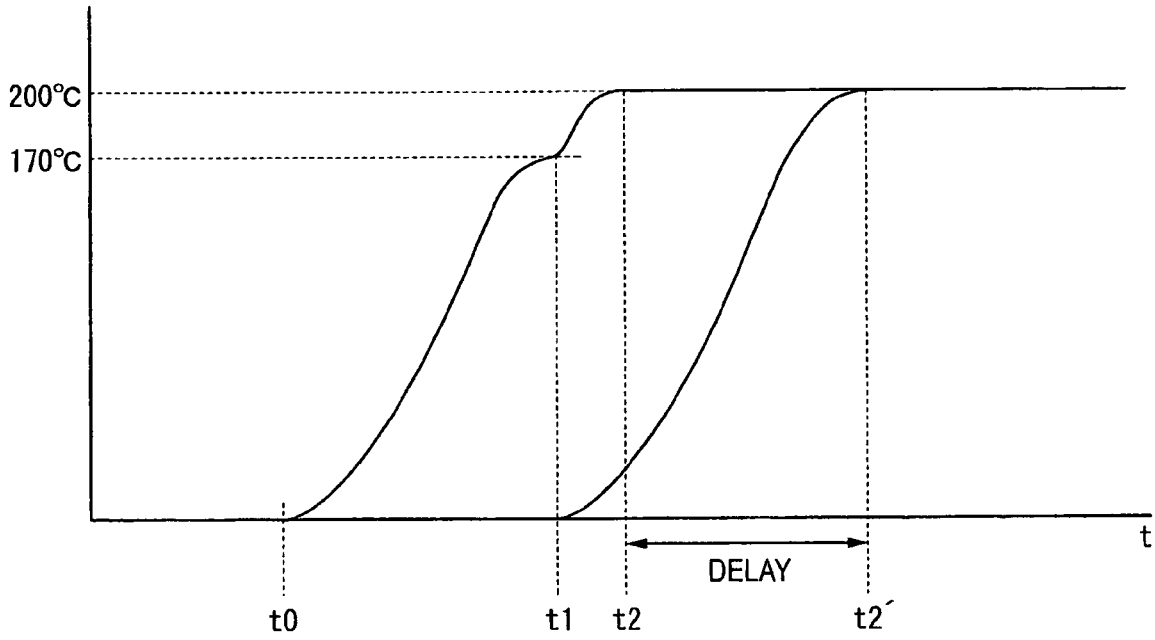
FIG. 7 is a view comparing times when a copying process starts.

As shown in FIG. 7, when the user makes a copy in the sleep mode, the copy mode key 96*a* is first depressed (time t0) to set the standby mode. The fixing unit 42 is heated from the sleep temperature (room temperature or the like) to the standby temperature (170° C.) (t0→t1). The time (t1–t0), which will elapse until the temperature reaches the standby temperature is set to a time when the user can complete placement of a document, setting of the number of copies, and like. When the user completes placement of a document, setting of the number of copies, and like and the start key 97 is depressed (time t1), the fixing mode is set. The fixing unit 42 is heated to the fixing temperature (200° C.) (t1→t2).

In the case where, the power mode is not to be transferred to the standby mode, even when the copy mode key 96*a* is depressed during the sleep mode, the user places a document. Then the start key 97 is depressed (time t1), whereby the fixing unit 42 is heated from the sleep temperature to the fixing temperature (t1→t2'). In this case, therefore, the fixing unit 42 is not heated until the start key 97 is depressed, and hence the power consumption can be correspondingly suppressed. However, the time, which elapses until the copying process is actually enabled is delayed by a time of t2→t2'. The end of the copying process is delayed by the time corresponding to the delay.

In the illustrative aspect of the invention, in the case where the sleep mode transfer time Tx, which is set by the user is longer than the default time Ta, which is previously set at shipment, there is a high possibility that such a user wishes to make a copy promptly. When the copy mode key 96*a* is depressed during the sleep mode, therefore, the CPU 90 transfers the power mode from the sleep mode to the standby mode. By contrast, in the case where the sleep mode transfer time Tx, which is set by the user is shorter than the default time Ta, there is a high possibility that such a user wishes to suppress the power consumption rather than to promptly make a copy. Even when the copy mode key 96*a* is depressed during the sleep mode, therefore, the CPU 90 does not transfer the power mode to the standby mode, but maintains the sleep mode.

The CPU 90 determines whether or not the sleep mode transfer time Tx, which is set by the user and is stored in the NVRAM 93 is longer than the default time Ta, which is previously stored in the NVRAM 93.

If the sleep mode transfer time Tx is longer than the default time Ta, the user usually wishes to frequently make a copy as described above. Therefore, the power mode is transferred to the standby mode so that the printing process can start at a relatively early timing. By contrast, if the sleep mode transfer time Tx is shorter than the default time Ta, the user usually wishes to suppress the power consumption. The power mode is maintained to the sleep mode.

4. Process of CPU

Next, the processes of the CPU during the copy operation and in the mode switching process after the end of image formation will be described with reference to the flowcharts of FIGS. 8 and 9.

<Process During Copy Operation>

Figure 8:
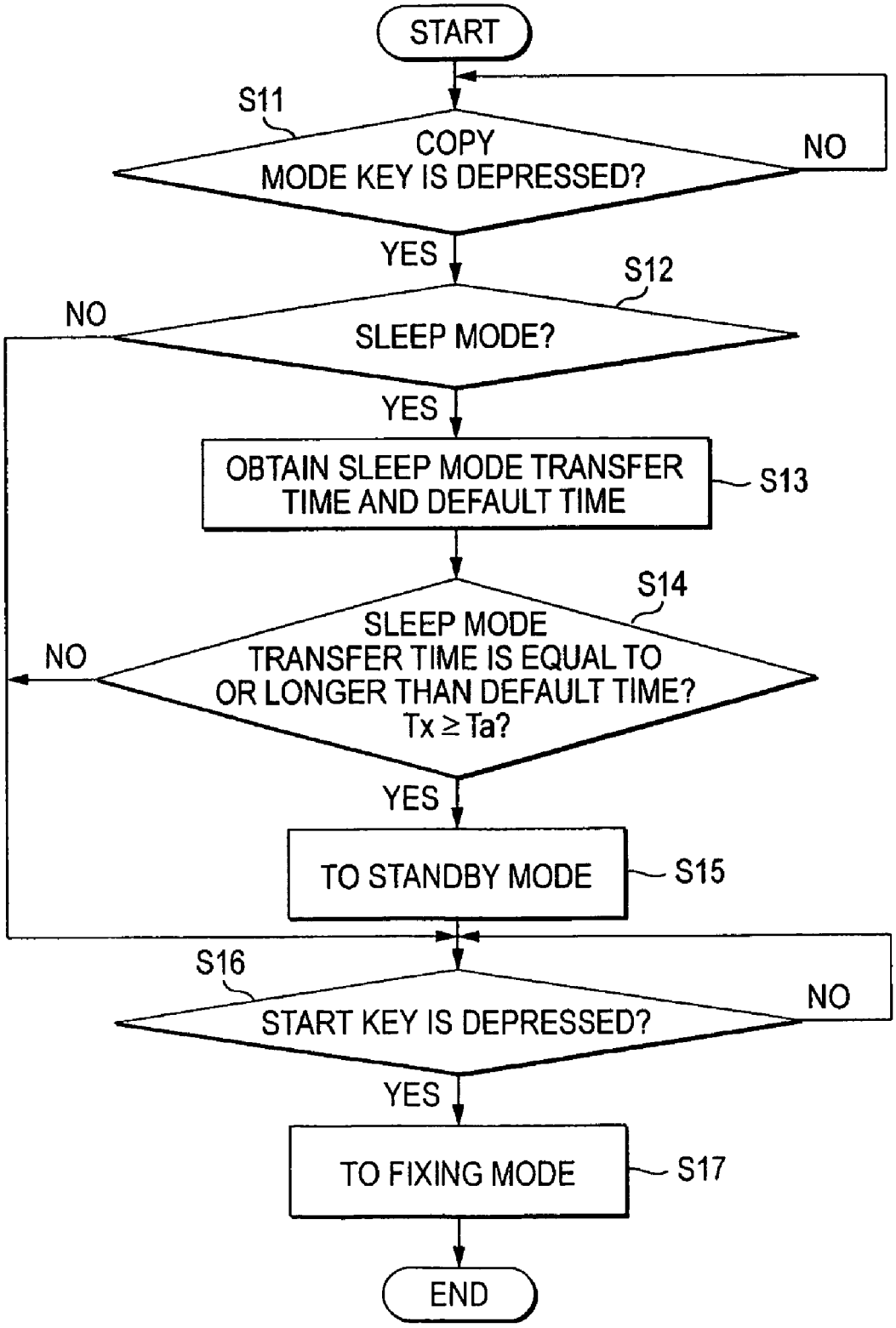
FIG. 8 is a flowchart showing a process of transferring a power mode when a copy mode is selected.

As shown in FIG. 8, when it is detected that the copy mode key 96*a* is depressed ("Y" in S11), the CPU 90 determines whether the current power mode is the sleep mode or not (S12).

If it is determined that the current power mode is not the sleep mode ("N" in S12), the CPU conducts no further operation and waits until the start key 97 is depressed (S16).

By contrast, if it is determined that the current power mode is the sleep mode ("Y" in S12), the CPU obtains the sleep mode transfer time TX and the default time Ta from the NVRAM 93.

It is determined whether the sleep mode transfer time Tx is equal to or longer than the default time Ta or not (S14). If the sleep mode transfer time Tx is shorter than the default time Ta ("N" in S14), there is a high possibility that the user who sets such a short sleep mode transfer time Tx wishes to suppress the power consumption; and hence the CPU maintains the sleep mode in which the power consumption is low, and waits until it is detected that the start key 97 is depressed (S16).

If the sleep mode transfer time Tx is equal to or longer than the default time Ta ("Y" in S14), there is a high possibility that the user who sets such a long sleep mode transfer time Tx is a user who frequently makes a copy, or who makes a copy with haste, and hence the power mode is transferred to the standby mode so that, in the copying process, the fixing unit 42 can be promptly heated to the fixing temperature (S15). As a result, heating of the fixing unit 42 is conducted until the standby temperature is obtained.

Next, when it is detected that the start key 97 is depressed ("Y" in S16), the power mode is transferred from the sleep mode or the standby mode to the fixing mode (S17). As a result, the fixing unit 42, which is at the sleep temperature or the standby temperature (or on the way to heating to the standby temperature) is heated to the fixing temperature. Thereafter, the printing process is conducted on the sheet.

<Mode Switching Process after End of Image Formation>

Figure 9:
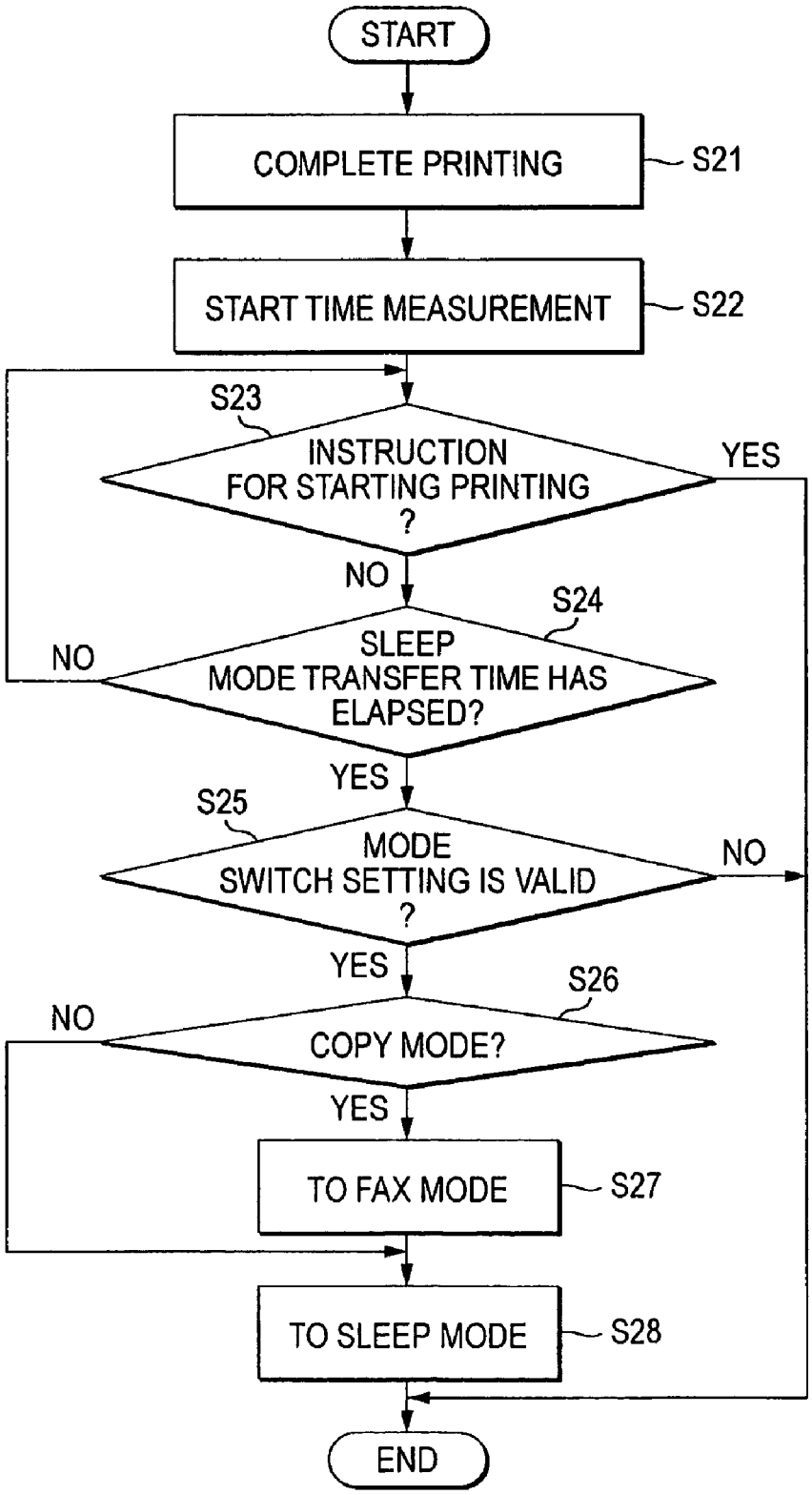
FIG. 9 is a flowchart showing a process of switching a functional mode in transfer to a sleep mode.

As shown in FIG. 9, when it is detected that the printing process is completed (S21), the CPU 90 starts measurement of the time (S22).

When an instruction for starting the printing process is again issued ("Y" in S23), the mode switching process ends.

In the case where, while an instruction for starting the printing process is not issued, the time, which has elapsed from the end of the image formation reaches the sleep mode transfer time TX stored in the NVRAM 93 ("N" in S23 and "Y" in s24), it is determined whether the mode switch setting stored in the NVRAM 93 is valid or not.

If the mode switch setting is set to be invalid ("N" in S25), the user does not wish to transfer to the sleep mode. The mode switching process ends.

By contrast, if the mode switch setting is set to be valid ("Y" in S25), the CPU 90 determines whether the current functional mode is the copy mode or not (S26).

If the current functional mode is the copy mode ("Y" in S26), the functional mode is transferred to the FAX mode (S27). As a result, to make a copy the user must first turn ON the copy mode key 96*a* to change the functional mode to the copy mode. Therefore, the turning-ON of the copy mode key 96*a* causes the power mode to be transferred to the standby mode, thereby conducting the prompt printing.

By contrast, if the current functional mode is other than the copy mode ("N" in S26), i.e. the FAX mode or the scanner mode, the mode is maintained because the user must turn ON the copy mode key 96*a* to make a copy.

After the power mode is transferred to the sleep mode (S28), the mode switching process ends. As a result, heating of the fixing unit 42 is stopped, and a screen indicative of transfer to the sleep mode is displayed on the touch panel 99.

5. Effects of the Illustrative Aspect (1) According to the illustrative aspect, when the copy mode is selected, it is possible to switch whether or not the fixing unit 42 is transferred from the sleep state to the standby state, in response to a user's request. In the case where the user has completed placement of a document, setting of the number of copies, and the like during, for example, a period when the temperature (room temperature or the like) of the sleep state is transferred to that (170° C.) of the standby state, after the user conducts an operation of turning ON the start key 97, therefore, the thermal fixing process is enabled simply by a heating process from the standby temperature to the fixing temperature (200° C.), and promptly making a copy. When the user does not wish to promptly make a copy, the control is switched so that, even when the copy mode is selected, the fixing unit 42 is not transferred from the sleep state to the standby state, whereby the power consumption can be suppressed.

(2) In many cases, the user who frequently makes a copy usually sets the time, which elapses until transfer to the sleep mode to be longer, thereby making a copy promptly. The user who does not frequently make a copy, and who wishes to suppress the power consumption usually sets the time, which elapses until transfer to the sleep state to be shorter.

According to the illustrative aspect, if the sleep mode transfer time Tx (sleep transfer time) is longer than the preset default time Ta (at shipment), the control is switched so that the transfer to the standby state is automatically conducted. Therefore, the state is transferred in accordance with the user's request. The transfer is automatically conducted, whereby the user is made free from the trouble of conducting a switching operation. By contrast, if it is determined that the sleep mode transfer time Tx is shorter than the default time Ta, the transfer to the standby state is not conducted, and hence the power consumption can be suppressed in response to the user's request.

(3) In the case where the functional mode is set to the copy mode when the power mode is to be transferred to the sleep mode, the sleep mode is set while maintaining the copy mode.

When the printing process is to be conducted, usually, the user sets sheets and the number to be printed. Then the user conducts an operation of starting the printing process. In the case where the sleep mode is set while maintaining the copy mode, therefore, it is not necessary to select the copy mode through the copy mode key 96*a*, and hence the start key 97 is directly depressed to heat the fixing unit 42. As a result, the time, which elapses until the copying process is completed is prolonged by a degree corresponding to a time, which elapses until the fixing unit 42 is heated to the fixing state.

By contrast, according to the illustrative aspect, if the current functional mode is the copy mode when the power mode is transferred to the sleep mode, the functional mode is changed to the FAX mode. When the FAX mode is set, the user who wishes to make a copy must select the copy mode through the copy mode key 96*a*. In the illustrative aspect, when such selection is done, heating of the fixing unit 42 starts. Before the user completes placement of a document, setting of the number of copies, and like, the fixing unit 42 can be heated to the standby temperature. Namely, when a starting operation to make a copy is done, it is requested only to heat the fixing unit 42 from the standby temperature to the fixing temperature. Therefore, the time of the copying process is shortened.

(4) In the case where, when the power mode is transferred to the sleep mode, the functional mode is changed from the copy mode to the FAX mode, the user who wishes to mainly use the copy mode must always conduct a cumbersome work of returning the functional mode from the changed other mode to the copy mode.

According to the illustrative aspect, in the case where the user mainly wishes to use the copy mode, when invalidation of the mode change is set through the mode switching invalidation selection screen (FIG. 6), the change from the copy mode to the FAX mode is inhibited during transfer to the sleep mode. Therefore, workability is improved.

(5) In the FAX mode, the thermal fixing process is not conducted. In the case where heating of the fixing unit 42 is conducted when this mode is set, the power is wastefully consumed. By contrast, according to the illustrative aspect, even when the FAX mode is selected, the transfer from the sleep state to the standby state by the CPU 90 is not conducted. Therefore, the power consumption is suppressed.

<Other Illustrative Aspect>

The invention is not restricted to the illustrative aspect, which has been described in the above description and with reference to the drawings. For example, also the following illustrative aspects fall within the scope of the invention. Moreover, various modifications other than the followings may be made without departing from the spirit of the invention.

(1) In the illustrative aspect, in the case where the sleep mode transfer time Tx is longer than the preset default time Ta, the power mode is automatically transferred to the standby mode, when the copy mode key 96*a* is turned ON. However, aspects of the invention are not restricted to the above. For example, setting whether to transfer to the standby mode may be preset in the operation section 6. The power mode may be transferred to the standby mode, when the copy mode key 96*a* is turned ON with this setting. Another example is that, each time when the copy mode key 96*a* is turned ON, it may be set whether to transfer to the standby mode in the operation section 6.

(2) In the illustrative aspect, when the start key 97 is turned ON by the user, a starting instruction to making a copy is given to the CPU 90. Alternatively, when a detection unit (not shown) formed by a detection sensor detects that a document is set on a document table, the starting instruction to make a copy may be given to the CPU 90.

What is claimed is:

1. An image forming apparatus comprising:

a reading unit that reads a document;

an image forming unit that forms an image on a sheet based on image data read by the reading unit;

a fixing unit that thermally fixes the image formed on the sheet;

a mode selecting unit that selects a first mode from a plurality of modes, in the first mode of which a document is read by the reading unit and the image is formed by the image forming unit;

a temperature controlling unit that controls a temperature of the fixing unit to be one of states, including:

a fixing state in which the fixing unit thermally fixes the image;

a standby state in which the temperature of the fixing unit is lower than the temperature in the fixing state; and a sleep state in which the temperature of the fixing unit is lower than the temperature in the standby state;

a sleep transferring unit that transfers the fixing state or the standby state to the sleep state, after a sleep transfer time has elapsed from an end of the thermal fixing by the fixing unit;

a switching unit that switches whether or not the fixing unit in the sleep state is transferred to the standby state, when the first mode is selected by the mode selecting unit, wherein when the switching unit switches to transfer to the standby state, the temperature controlling unit controls the temperature of the fixing unit to transfer from the sleep state to the standby state, and when the switching unit switches not to transfer to the standby state, the temperature controlling unit controls the temperature of the fixing unit to be in the sleep state until receiving a starting instruction of a copying process;

a sleep transfer time setting unit that sets the sleep transfer time; and a determining unit that determines whether the sleep transfer time is longer than a preset default time, wherein when the determining unit determines that the sleep transfer time is longer than the preset default time, the switching unit switches to transfer from the sleep state to the standby state, and when the determining unit determines that the sleep transfer time is shorter than the preset default time, the switching unit does not switch to transfer from the sleep state to the standby state.

2. The image forming apparatus according to claim 1, further comprising:

a sleep determining unit that determines whether the sleep transfer time has elapsed;

a mode determining unit that determines whether the first mode is set, if the sleep determining unit determines that the sleep transfer time has elapsed; and a mode changing unit that changes the first mode to a second mode, if the mode determining unit determines that the first mode is set.

3. The image forming apparatus according to claim 2, further comprising:

a default mode setting unit that sets a mode, which a user mainly uses, wherein if a mode set by the default mode setting unit is the first mode, the mode changing unit is inhibited from changing from the first mode to the second mode.

4. The image forming apparatus according to claim 2, wherein the second mode includes a facsimile mode in which a document to be transmitted for facsimile is read.

5. The image forming apparatus according to claim 1, wherein, the temperature controlling unit stops heating of the fixing unit in the sleep state.

6. The image forming apparatus according to claim 1, wherein the sleep transfer time is displayed on a display unit.

* * * * *